United States Patent [19]

Lorenzini

[11] 4,225,041

[45] Sep. 30, 1980

[54] DUAL-HINGED CASE

[76] Inventor: Robert A. Lorenzini, 603 S. State Rd. 7, Margate, Fla. 33068

[21] Appl. No.: 948,141

[22] Filed: Oct. 3, 1978

[51] Int. Cl.[2] ..... A45C 11/00; B65D 85/20

[52] U.S. Cl. ..... 206/314; 206/261; 220/4 B

[58] Field of Search ..... 206/45.18, 261–263, 206/314, 379; 220/4 B, 339

[56] References Cited

U.S. PATENT DOCUMENTS

| | | | |
|---|---|---|---|
| 1,625,651 | 4/1927 | Gretsch | 206/314 X |
| 1,997,820 | 4/1935 | Govoni | 206/314 |
| 2,197,053 | 4/1940 | Meincke | 206/261 X |
| 2,197,565 | 4/1940 | Brand | 206/314 |
| 2,652,060 | 9/1953 | Shio | 206/261 X |
| 2,937,740 | 5/1960 | Bruckman | 206/314 |
| 3,344,913 | 10/1967 | Best | 220/339 X |
| 3,393,793 | 7/1968 | Eresman | 206/314 |
| 3,670,871 | 6/1972 | Thomas | 206/314 |

FOREIGN PATENT DOCUMENTS

| | | | |
|---|---|---|---|
| 242079 | 8/1965 | Austria | 206/379 |
| 613659 | 8/1926 | France | 206/314 |
| 762011 | 1/1934 | France | 206/314 |
| 6062 | of 1907 | United Kingdom | 206/314 |
| 1263203 | 2/1972 | United Kingdom | 206/261 |

*Primary Examiner*—Herbert F. Ross

*Attorney, Agent, or Firm*—Francis X. Doyle; Richard A. Menelly

[57] ABSTRACT

A dual-hinged case adaptable for holding various items and in particular one or more types of reeds used in musical woodwind instruments. A dual-hinged case is provided capable of utilizing varying holding means to permit the safe retention of various types of items, as for example, reeds such as those used by a clarinet or saxophone and those used by an oboe, English horn or bassoon.

8 Claims, 6 Drawing Figures

DUAL-HINGED CASE

BACKGROUND OF THE INVENTION

The present invention relates to a dual-hinged case and more specifically to a dual-hinged case adaptable for holding various items, as for example, reeds of musical woodwind instruments.

Carrying cases are well-known. However, there is a need for an inexpensively produced case which can be readily adapted for safely and conveniently carrying various types of items without the manufacture of an entirely different case for each type of item.

D. L. De Myers in U.S. Pat. No. 369,438 teaches a case for carrying medicine. Two sides of the case taught by De Myers are hinged to a centrally located base section. A vertical centerpiece on which items, namely bottles, is provided.

The T. Joyse Jr. patent, U.S. Pat. No. 1,727,235, teaches a first aid kit similar to the De Myers patent. Joyse, however, teaches a center compartment enclosed at the top with carrying compartments within the side sections.

The J. Warner patent, U.S. Pat. No. 1,960,073 teaches a jewelry box with channel element of spring material for holding a piece of jewelry.

The Cheng Shio patent, U.S. Pat. No. 2,652,060, teaches a cigarette carrying case with the special feature of lighting a cigarette by withdrawal from the case. A holder is provided in a centrally-located base section between two pivotable side sections into which holder the ends of the cigarettes are inserted and thus the cigarettes held in place.

The D. P. Epstein patent, U.S. Pat. No. 3,132,741 teaches a pop-up box using hinges of creased material.

None of these patents pertain specifically to the carrying of reeds for musical woodwind instruments. Of even greater significance is that none of these patents teaches a carrying case which can be fitted with different holders for holding different devices. This makes possible specifically the utilization of the same case for carrying of different reeds of different sizes and shapes within the same case, by placing the proper holder within the case. In this way, the same case can be produced for various reeds and other items and only the specific holder need be specially produced for each reed.

These and various other problems were not satisfactorily resolved until the emergence of the instant invention.

SUMMARY OF THE INVENTION

In accordance with the present invention, there is provided a dual-hinged case for the reeds of a variety of woodwind instruments and also for carrying other items. The present invention provides a carrying case which is simple to construct, low in cost, and which can be quickly adapted to hold different items without necessitating the production of an entirely new case.

Two side sections are pivotably mounted on a base section. A pair of spaced, resilient strips are integrally attached to the base staton. A means for holding items is held between the resilient strips.

The novel features which are considered as characteristic of the invention are set forth with particularity in the appended claims. The invention itself, however, as to its construction and obvious advantages will be best understood from the following description of the specific embodiment when read with the accompanying drawings.

DETAILED DESCRIPTION OF THE PREFERRED EMBODIMENTS OF THE INVENTION

Figure 1:
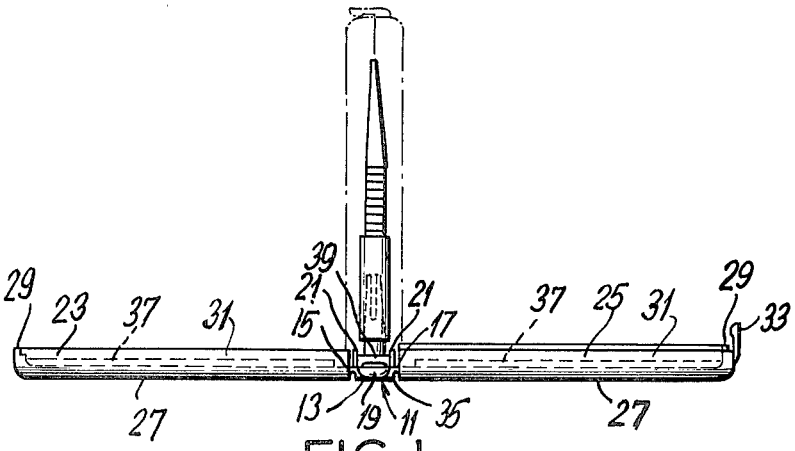
FIG. 1 is an end view of the dual-hinged case in its open position showing double reeds within the carrying case and with its closed position shown in dotted lines.

The same reference numerals are used throughout the drawings and specification to denote a similar item of the invention.

Figure 3:
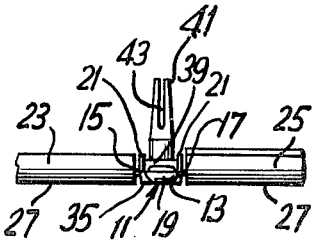
FIG. 3 is an end view of the dual-hinged case shown in FIG. 2 with the case fully open and with the reeds removed.
Figure 2:
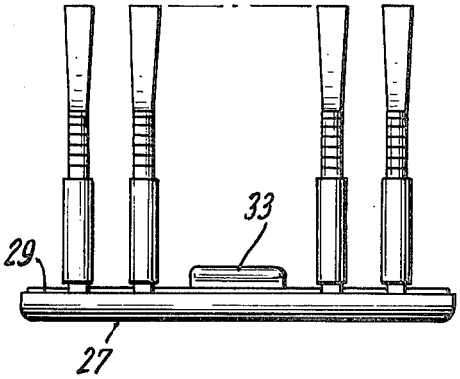
FIG. 2 is a front view of the dual-hinged case shown in FIG. 1 with the case fully open and with only some of the double reeds in place.
Figure 4:
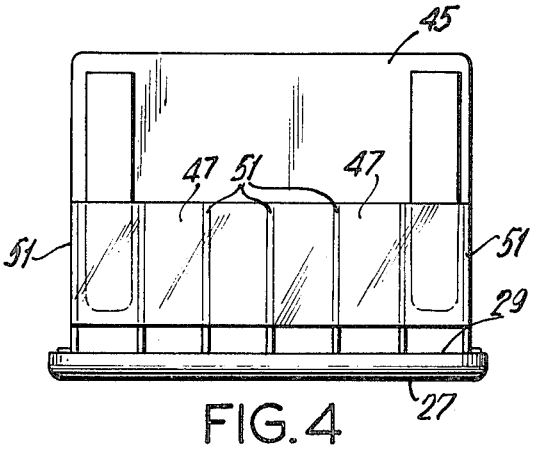
FIG. 4 is a front view of the dual-hinged case in its fully open position showing only some single reeds within the carrying case.
Figure 5:
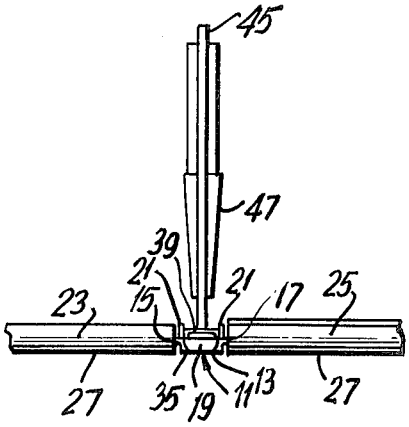
FIG. 5 is an end view of the dual-hinged case for holding single reeds and in its fully open position with reeds in place.
Figure 6:
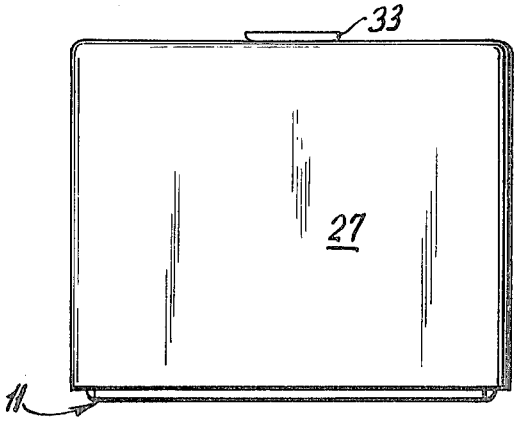
FIG. 6 is a front view of the dual-hinged case in its fully closed position.

Referring to FIG. 1, FIG. 3 and FIG. 5, a base section 11 is shown including a flat member 13 being rectangularly-shaped with a first major edge 15 and a second major edge 17, substantially parallel to one another. The flat member 13 also includes two minor edges 19 both substantially parallel to one another and both substantially shorter than the two major edges 15, 17. The base section 11 further includes a pair of strips 21 mounted on the flat member 13 substantially parallel to one another and to the two major edges 15, 17 of the flat member 13. The pair of strips 21 may be secured to the flat member 13 by any means but preferably would be molded as part of the flat member 13. The pair of strips 21 are resilient and are located upright, at substantially right angles to the flat member 13 with both of the parallel strips 21 being on the same side of the flat member 13.

As is best seen in FIG. 1, the carrying case has two side sections, namely a first side section 23 and a second side section 25, each of which has a side panel 27 which is generally rectangularly-shaped. The two side sections 23, 25 are mirror images of one another. Each side section 23, 25 also includes an outer lip 29 and two side lips 31. The lips 29, 31 are directed inwardly and extend substantially at right angles to the side panel 27. Each of the lips 29, 31 extends a distance approximately equal to one-half the width of the flat member 13 of the base section 11. In this way, when the carrying case is closed, the two side panels 27 are substantially parallel to one another and are substantially at right angles to the base section 11.

A latch 33 is connected to the outside of the upper lips 29 to secure the side secttons 23, 25 together.

The two side sections 23, 25 are each pivotably mounted on the two main edges 15, 17 of the flat member 13 of the base section 11 by a hinge means 35. Preferably the base section 11 and the two side sections 23, 25 are molded together. In this way, the hinge means 35 is an integrally-molded captive hinge.

A layer 37 of soft material, preferably a plastic foam, is secured to the handle of each of the two side sections 23, 25 to press gently against the reeds preventing their dislocation during transportation of the carrying case.

In order economically to produce a molded unit, as has been described, a large potential sales market is required. To limit, therefore, each molded carrying case to a particular item, as for example one type of reed, would not be practical. Therefore, it is essential that the one case hold either single or different sizes of double reeds. The same concept may be used for a carrying case to hold other items of the same overall general size.

A base plate 39, having a rectangular shape, is sized to fit securely but removably between the pair of strips 21 located on the flat member 13 of the base section 11.

If a carrying case for double reeds is desired, a series of tapered pins 41, each with a slot 43 vertically located in the upper end are secured to the base plate 39. If a carrying case for single reeds is desired, a flat panel 45 is secured to the base plate 39 centrally between and parallel with the two major edges 17, 19. The flat panel 45 is rectangular in shape and extends upwardly from the base plate 39 slightly less than do the side panels 27. Pockets 47 are formed along the flat panel 45, preferably on both sides of the flat panel 45. The pockets 47 are formed from a thin layer of flexible material having a rectangular shape, secured to the lower area of the flat panel 45 by a series of vertical seams 51 substantially equally spaced from one another and at right angles to the base plate 39.

The carrying case, as shown in the drawings, which is the preferred embodiment, is dimensioned to hold ten double reeds or twelve single reeds. The twelve single reeds are located with six single reeds being located on each side of the flat panel 45. However, the carrying case may be smaller or larger and may be utilized with other items.

The invention may be embodied in other specific forms without departing from the spirit or essential characteristics thereof. The present embodiments are, therefore, to be considered in all aspects as illustrative and not restrictive. The scope of the invention being indicated by the appended claims rather than the foregoing description and all changes which come within the meaning and range of equivalency of the claims are therefore, intended to be embraced therein.

I claim:

1. A dual-hinged case for carrying items, comprising:

a base section, said base section including a flat member of rectangular shape with a first major edge and a second major edge and with a pair of substantially parallel strips parallel to said first major edge and said second major edge and both located on the same side of said flat member at substantially right angles to said flat member, said parallel strips being resilient;

a first side section pivotably mounted on the first major edge of said base section;

a second side section pivotably mounted on the second major edge of said base section, said first side section and said second side section being adapted to contact one another with the first side section and the second side section substantially at right angles to said base section;

latch means for retaining said first side section and said section side section together; and holding means for supporting items within the case including a base plate of rectangular shape and adapted to be retained securely but removably between said pair of parallel strips.

2. A dual-hinged case according to claim 1 wherein said first side section and said second side section are both rectangular.

3. A carrying case according to claim 1 wherein said first side section and said second side section each have an outer lip and two side lips.

4. A carrying case according to claim 3 wherein on both said first side section and said second side section the outer lip and the two side lips extend at substantially right angles to their respective side sections.

5. A carrying case according to claim 1 wherein said holding means includes at least one tapered pin mounted on said base plate for holding reeds.

6. A dual-hinged case according to claim 1 wherein said holding means includes:

a flat panel mounted on said base plate substantially at right angles to said base plate; and at least one pocket mounted on said flat panel for holding a reed.

7. A carrying case according to claim 6 with pockets mounted on both sides of said flat panel.

8. A dual-hinged case for carrying items comprising:

a base section, said base section including a flat member of rectangular shape with a first major edge and a second major edge and with a pair of substantially parallel strips parallel to said first major edge and said second major edge and both located on the same side of said flat member at substantially right angles to said flat member, said parallel strips being resilient;

a first side section pivotably mounted on the first major edge of said base section;

a second side section pivotably mounted on the second major edge of said base section, said first side section and said second side section each being rectangular and each having an outer lip and two side lips, which extend at substantially right angles to their respective side sections, said first side section and said second side section being adapted to contact one another with the first side section and the second side section substantially at right angles to said base section;

latch means for retaining said first side section and said second side secton together; and holding means for supporting items within the case including a base plate of rectangular shape and adapted to be retained securely and removably between said pair of parallel strips.

* * * * *